US006475103B1

(12) United States Patent
Kato

(10) Patent No.: US 6,475,103 B1
(45) Date of Patent: Nov. 5, 2002

(54) THREAD WOUND GOLF BALL

(75) Inventor: Akira Kato, Kobe (JP)

(73) Assignee: Sumitomo Rubber Industries, Ltd., Hyogo-ken (JP)

( * ) Notice: Subject to any disclaimer, the term of this patent is extended or adjusted under 35 U.S.C. 154(b) by 0 days.

(21) Appl. No.: 09/324,125

(22) Filed: Jun. 2, 1999

(30) Foreign Application Priority Data

Jun. 2, 1998 (JP) ..... 10-152827
Mar. 31, 1999 (JP) ..... 11-092042

(51) Int. Cl.[7] ..... A63B 37/06

(52) U.S. Cl. ..... 473/357; 473/373; 473/374; 473/375; 473/376; 473/377

(58) Field of Search ..... 473/373, 374, 473/375, 376, 377, 357

(56) References Cited

U.S. PATENT DOCUMENTS 5,810,677 A * 9/1998 Maruko ..... 473/357
5,830,085 A * 11/1998 Higuchi ..... 473/373
5,976,034 A * 11/1999 Kato ..... 473/363
5,993,968 A * 11/1999 Umezawa ..... 428/407

FOREIGN PATENT DOCUMENTS

GB 2311732 A 10/1997
GB 2311733 A 10/1997
GB 2317834 A 4/1998
GB 2324046 A 10/1998

OTHER PUBLICATIONS

Japanese Patent No. 2715885 and its corresponding USP 5,445,387.
Japanese Patent Kokai Publication No. 271537/1997 and its corresponding USP 5,848,942.
Japanese Patent Kokai Publication No. 201551–1998 and its corresponding UK Patent Application 2,311,733.

* cited by examiner

*Primary Examiner*—Peter Vo
*Assistant Examiner*—Paul Kim
(74) *Attorney, Agent, or Firm*—Birch, Stewart, Kolasch & Birch, LLP

(57) ABSTRACT

The present invention provides a solid center type thread wound golf ball having long flight distance, while having good shot feel at the time of hitting the golf ball as good as liquid center type thread wound golf balls. The present invention thus provides a thread wound golf ball comprising a solid center, a thread rubber layer formed on the solid center, and a cover covering the thread rubber layer wherein, the solid center has a diameter of 33 to 38 mm, a ratio of surface hardness in JIS-C hardness to diameter of 2.15 to 2.50, and a ratio of center hardness in JIS-C hardness to diameter of 1.30 to 2.00, and the cover has a Shore D hardness of 40 to 65. Further, the solid center of the thread wound golf ball has a center hardness in JIS-C hardness of 50–75, and a surface hardness larger than the center hardness by not less than 10, and the thread rubber layer has a thickness of 1.0 to 4.0 mm.

18 Claims, No Drawings

THREAD WOUND GOLF BALL

FIELD OF THE INVENTION

The present invention relates to a thread wound golf ball. More particularly, it relates to a solid center type thread wound golf ball having a long flight distance, while having a soft and good shot feel at the time of hitting, as good as liquid center type thread wound golf balls.

BACKGROUND OF THE INVENTION

Many golf balls are commercially selling, but they are typically classified into solid golf balls such as a two-piece golf ball, a three-piece golf ball and the like, and thread wound golf balls. The solid golf ball consists of a solid core of molded rubber material and a cover of thermoplastic resin (e.g. ionomer resin) covering on the solid core. The thread wound golf ball consists of a solid or liquid center, a thread wound layer formed on the center and a cover of ionomer resin or balata etc. having a thickness of 1 to 2 mm covering on the thread wound layer.

The thread wound golf ball, when compared with the solid golf ball, has better shot feel at the time of hitting and better controllability at a approach shot. The thread wound golf ball is generally approved of or employed by high level golfers, especially professional golfers, who regard these characteristics as most important.

In the thread wound golf balls, there are two types, namely one comprising a solid center formed from integrally molded rubber material, and the other comprising a liquid center composed of a hollow rubber sphere and liquid encapsulated in the sphere. Among them, a thread wound golf ball comprising a liquid center and a balata (transisoprene) cover is particularly approved of or employed by high level golfers, especially professional golfers, because of the good shot feel and excellent controllability at the approach shot. However, the liquid center type thread wound golf ball does not show long flight distance when compared with the solid center type thread wound golf ball.

In addition, the liquid center type thread wound golf ball has poor rebound characteristics at a low temperature, although the solid center type thread wound golf ball has no deterioration of performance depending on temperature change. Accordingly, the solid center type thread wound golf ball has been generally employed and studied.

In order to impart soft shot feel and good controllability to the solid center type thread wound golf ball, it has been proposed in Japanese Patent No. 2715885, Japanese Patent Kokai Publication Nos. 271537/1997 and 201881/1998, and the like that the solid center of the solid center type thread wound golf ball be controlled to have a suitable hardness distribution, whereby compromising flight distance with shot feel and controllability.

However, these proposed solid center type thread wound golf balls do not show sufficient performance. Therefore, it is required to provide the solid center type thread wound golf ball, so that has sufficient flight distance as long as solid golf balls, while keeping the advantage of a good shot feel and excellent controllability as good as the liquid center type thread wound golf balls.

OBJECTS OF THE INVENTION

A main object of the present invention is to provide a solid center type thread wound golf ball having long flight distance, and having a soft and good shot feel at the time of hitting the ball as good as the liquid center type thread wound golf ball.

According to the present invention, the object described above has been accomplished by employing a thread wound core which comprises a solid center, and adjusting a diameter, a ratio of surface hardness in JIS-C hardness to diameter and a ratio of center hardness in JIS-C hardness to diameter in a solid center, and controlling a Shore D hardness of a cover to a specified range, thereby providing a solid center type thread wound golf ball having long flight distance, while having good shot feel at the time of hitting as good as the liquid center type thread wound golf ball.

SUMMARY OF THE INVENTION

The present invention provides a thread wound golf ball comprising a solid center, a thread rubber layer formed on the solid center, and a cover covering the thread rubber layer, wherein the solid center has a diameter of 33 to 38 mm, a ratio of surface hardness in JIS-C hardness to diameter of 2.15 to 2.50, and a ratio of center hardness in JIS-C hardness to diameter of 1.30 to 2.00, and the cover has a Shore D hardness of 40 to 65.

DETAILED DESCRIPTION OF THE INVENTION

The thread wound golf ball of the present invention will be explained hereinafter. The golf ball of the present invention comprises a solid center, a thread rubber layer formed on the solid center, and a cover formed on the thread rubber layer. The solid center is formed from a rubber composition comprising a base rubber, a co-crosslinking agent, an organic peroxide, a filler and the like.

The base rubber may be natural rubber and/or synthetic rubber, which has been conventionally used for solid golf balls. Preferred is high-cis polybutadiene rubber containing a cis-1,4 bond of not less than 40%, preferably not less than 80%. The polybutadiene rubber may be mixed with natural rubber, polyisoprene rubber, styrene-butadiene rubber, ethylene-propylene-diene rubber (EPDM), and the like.

The co-crosslinking agent may be a metal salt of α,β-unsaturated carboxylic acid, particularly mono- or di-valent metal salts, such as zinc or magnesium salts of α,β-unsaturated carboxylic acids having 3 to 8 carbon atoms (e.g. acrylic acid, methacrylic acid, etc.). The preferred co-crosslinking agent is zinc acrylate because it imparts high rebound characteristics to the resulting golf ball. The amount of the co-crosslinking agent may be 10 to 40 parts by weight, preferably 15 to 35 parts by weight, based on 100 parts by weight of the base rubber. When the amount of the co-crosslinking agent is larger than 40 parts by weight, the center is too hard, and the shot feel is poor. On the other hand, when the amount of the co-crosslinking agent is smaller than 10 parts by weight, the center is soft. Therefore the rebound characteristics are degraded which reduce flight distance.

The crosslinking agents may be an organic peroxide such as dicumyl peroxide, 1,1-bis(t-butylperoxy)-3,3,5-trimethylcyclohexane, 2,5-dimethyl-2,5-di(t-butylperoxy)-hexane, di-t-butyl peroxide and the like. The preferred organic peroxide is dicumyl peroxide. The amount of the organic peroxide is not limited, but may be from 0.5 to 2.0 parts by weight, preferably 0.8 to 1.5 parts by weight, based on 100 parts by weight of the base rubber. When the amount of the organic peroxide is smaller than 0.5 parts by weight, the center is too soft. Therefore the rebound characteristics are degraded which reduces flight distance. On the other hand, when the amount of the organic peroxide is larger than 2.0 parts by weight, the center is too hard, and the shot feel is poor.

The filler, which can be used for the core of the golf ball, includes for example, an inorganic filler (such as zinc oxide, barium sulfate, calcium carbonate, and the like), a high specific gravity metal powder (such as tungsten powder, molybdenum powder, and the like), and mixture thereof. The amount of the filler is not limited and can vary depending on the specific gravity and size of the center, the thread rubber layer and the cover, but may be from 20 to 70 parts by weight, preferably 25 to 60 parts by weight, based on 100 parts by weight of the base rubber. When the amount of the filler is smaller than 20 parts by weight, the center is too light, and the resulting golf ball is too light. On the other hand, when the amount of the filler is larger than 70 parts by weight, the center is too heavy and the resulting golf ball is too heavy.

The rubber composition for the solid center of the present invention can contain other components, which have been conventionally used for preparing the core of solid golf balls, such as antioxidants or peptizing agents. The amount of the antioxidant is preferably 0.2 to 0.5 parts by weight based on 100 parts by weight of the base rubber.

The solid center is obtained by mixing the rubber composition in an internal mixer (a Banbury mixer or a kneader), or a mixing roll; followed by vulcanizing or press-molding the rubber composition in a mold. In the thread wound golf ball of the present invention, the solid center has a diameter of 33 to 38 mm, preferably 34 to 37 mm, which is larger than that of the conventional thread wound golf ball. When the diameter of the solid center is smaller than 33 mm, the spin amount at the time of hitting increases and the flight distance is reduced. On the other hand, when the diameter of the solid center is larger than 38 mm, the thread rubber layer is too thin. Therefore, rebound characteristics as the technical effects of the thread rubber layer are not sufficiently exhibited and the before flight distance is reduced.

The solid center used in the present invention has a ratio of surface hardness in JIS-C hardness to diameter (surface hardness (degree)/diameter (mm)) of 2.15 to 2.50, preferably 2.19 to 2.50. When the ratio is smaller than 2.15, the center is too soft, and the resulting golf ball does not have a proper hardness to degrade rebound characteristics. On the other hand, when the ratio is larger than 2.50, the center is too hard, and the shot feel of the resulting golf ball is poor, the spin amount increases and the flight distance is reduced. The solid center used in the present invention also has a ratio of center hardness in JIS-C hardness to diameter (center hardness (degree)/diameter (mm)) of 1.30 to 2.00, preferably 1.50 to 2.00. When the ratio is smaller than 1.30, the center is too soft, and the rebound characteristics of the resulting golf ball are degraded and the flight distance is reduced. On the other hand, when the ratio is larger than 2.00, the center is too hard, and the shot feel of the resulting golf ball is not only poor, but the spin amount increases and the flight distance is reduced.

The solid center used in the present invention has a center hardness in JIS-C hardness of 50 to 75, preferably 60 to 65, and the surface hardness of the solid center is larger than the center hardness by not less than 10, preferably 10 to 20. The JIS-C hardness is substantially the same as Shore C hardness. When the center hardness is smaller than 50, the rebound characteristics of the resulting golf ball are degraded and the flight distance is reduced. When the hardness is larger than 75, the shot feel of the resulting golf ball is not only poor, but the spin amount increases and the flight distance is reduced. When the difference between the surface hardness and the center hardness is less than 10, the shot feel is not as soft as that of a thread wound golf ball comprising a liquid center. The term "center hardness" of a solid center as used herein refers to the hardness, which is obtained by cutting the center into two equal parts and then measuring JIS-C hardness at center point. The thread rubber layer is then formed on the solid center.

The thread rubber wound on the solid center can be the same one as that which has been conventionally used in the thread rubber layer of the thread wound golf balls. For example, the thread rubber can be one that is obtained by vulcanizing a rubber composition prepared by formulating sulfur, a vulcanization accelerator, a vulcanization aid, an antioxidant and the like to a natural rubber or a blend rubber of the natural rubber and a synthetic polyisoprene. The thread rubber is wound on the solid center by conventional methods which have been before used for the thread wound core of the thread wound golf balls. The thread rubber layer may have a thickness of 1.0 to 4.0 mm, preferably 1.2 to 3.5 mm. When the thickness of the thread rubber layer is smaller than 1.0 mm, the thread rubber layer is too thin to exhibit sufficient impact relaxation, and the shot feel is poor. On the other hand, when the thickness is larger than 4.0 mm, the spin amount at the time of hitting increases and the flight distance is reduced. The cover is then formed on the thread rubber layer.

The cover of the present invention may be formed from an ionomer resin which is known to the art and has been used for the cover of golf balls and may be used alone, but the ionomer resin may be suitably used in combination with a thermoplastic elastomer or resin. Examples of the combinations include:

(i) a heated mixture of an ionomer resin and an epoxy group-modified thermoplastic elastomer, (ii) a heated mixture of an ionomer, a maleic anhydride-modified thermoplastic elastomer and a glycidyl group-modified thermoplastic elastomer, (iii) a heated mixture of an ionomer and a terpolymer of ethylene-unsaturated carboxylic acid ester-unsaturated carboxylic acid, and (iv) a heated mixture of an ionomer resin, a maleic anhydride-modified thermoplastic elastomer or terminal OH-containing thermoplastic elastomer, and an epoxy group-modified thermoplastic elastomer. The term "modification" as used herein refers to what certain group has been introduced into elastomer molecule. Accordingly, the "epoxy group-modified" thermoplastic elastomer refers to a thermoplastic elastomer into which an epoxy group is introduced.

Examples of the ionomer resin, which is commercially available from Mitsui Du Pont Polychemical Co., Ltd. include Hi-milan 1555 (Na), Hi-milan 1557 (Zn), Hi-milan 1601 (Na), Hi-milan 1605 (Na), Hi-milan 1706 (zn), Hi-milan AM7317 (Zn) and Hi-milan AM7318 (Na) as the copolymer ionomer resin; and Hi-milan 1856 (Na), Hi-milan 1855 (Zn) and Hi-milan AM7316 (Zn) as the terpolymer ionomer resin. Examples of the ionomer resin, which is commercially available from Du Pont U.S.A., include Surlyn AD8511 (Zn) and Surlyn AD8512 (Na) as the copolymer ionomer resin; and Surlyn AD8265 (Na) and Surlyn AD8269 (Na) as the terpolymer ionomer resin. These ionomer resins are used alone or in combination thereof. Incidentally, Na and Zn, which are described in parentheses after the trade name of the above ionomer resin indicate metal ion species for neutralization.

Examples of the epoxy group-modified thermoplastic elastomer, which has epoxy groups in elastomer molecule, include styrene-butadiene-styrene (SBS) block copolymers having polybutadiene block with epoxy groups, which are commercially available from Daicel Chemical Industries Co., Ltd. under the trade name of "Epofriend A1010", "Epofriend A1005", "Epofriend A1020", and the like.

Examples of the maleic anhydride-modified thermoplastic elastomer include maleic anhydride adducts of hydrogenated styrene-butadiene-styrene block copolymers, which are commercially available from Asahi Chemical Industries Co., Ltd. under the trade name of "Taftek M" series; ethylene-ethyl acrylate-maleic anhydride terpolymers, which are commercially available from Sumitomo Chemical Industries Co., Ltd. under the trade name of "Bondine"; and products obtained by graft-modifying ethylene-ethyl acrylate copolymers with maleic anhydride, which are commercially available from Mitsui Du Pont Polychemical Co., Ltd. under the trade name of "AR" series. They are suitably used in the present invention.

Examples of the glycidyl group-modified thermoplastic elastomer include ethylene-glycidyl methacrylate copolymer, ethylene-glycidyl methacrylate-methyl acrylate terpolymer, ethylene-glycidyl methacrylate-vinyl acetate terpolymer, which are commercially available from Sumitomo Chemical Industries Co., Ltd. under the trade name of "Bondfast"; glycidyl methacrylate adducts of hydrogenated styrene-butadiene-styrene (SBS) block copolymers, which are commercially available from Asahi Chemical Industries Co., Ltd. under the trade name of "Taftek Z514", "Taftek Z513" and the like; adducts of ethylene-acrylic ester-glycidyl methacrylate terpolymer, which are commercially available from Du Pont U.S.A. under the trade name of "Elvaloy-AS". Although the glycidyl group is broadly classified into the epoxy group, the term "glycidyl group" herein is used for making clear the difference between epoxy group and glycidyl group. Accordingly, the "glycidyl group" in this specification is different from the "epoxy group".

Examples of the terpolymer of ethylene-unsaturated carboxylic acid ester-unsaturated carboxylic acid include ethylene-isobutyl acrylate-methacrylic acid terpolymer, which is commercially available from Mitsui Du Pont Polychemical Co., Ltd. under the trade name of "Neucrel AN4212C", "Neucrel N0805J" and the like.

Examples of the terminal OH-containing thermoplastic elastomer include hydrogenated styrene-isoprene-styrene (SIS) block copolymers having terminal OH groups, which is commercially available from Kuraray Co., Ltd.

In order to obtain a desired hardness from a cover composition containing ionomer resin and another elastomer as base resin component (i.e. combinations (i) to (iv)), a ratio of ionomer resin to the other resin (the epoxy group-modified thermoplastic elastomer, the maleic anhydride-modified thermoplastic elastomer and the terpolymer of ethylene-unsaturated carboxylic acid ester-unsaturated carboxylic acid) is preferably 95:5 to 20:80.

In the case of employing the combination of ionomer resin and the other resin, it is required to subject both to heat mixing. The heat mixing is typically conducted by mixing for 1 to 20 minutes, and practically conducted in a extruder with controlling temperature.

In the golf ball of the present invention, the resin composition for the cover may optionally contain fillers (such as barium sulfate, etc.), pigments (such as titanium dioxide, etc.), and other additives (such as a dispersant, an antioxidant, a UV absorber, a photostabilizer and a fluorescent agent or a fluorescent brightener, etc.), in addition to the resin component, as long as the addition of the additive does not deteriorate the desired performance of the golf ball cover. However, the amount of the pigment is preferably from 1.0 to 6.0 parts by weight based on 100 parts by weight of the cover resin.

The cover of the present invention may be formed by conventional methods, which have been known to the art and used for forming the cover of the golf balls. For example, there can be used a method comprising molding the cover composition into a semi-spherical half-shell, covering the thread wound core with the two half-shells, followed by pressure molding at 130 to 170° C. for 1 to 5 minutes, or a method comprising injection molding the cover composition directly on the thread wound core to cover it.

The cover of the present invention has a Shore D hardness of 40 to 65, preferably 42 to 63, more preferably 45 to 60, most preferably 47 to 56. When the hardness is smaller than 40, the cover is too soft, and the rebound characteristics of the resulting golf ball are degraded and the flight distance is reduced. On the other hand, when the hardness is larger than 65, the shot feel of the resulting golf ball is poor. The cover preferably has a thickness of 1.0 to 3.0 mm, more preferably 1.2 to 2.5 mm. When the thickness of the cover is smaller than 1.0 mm, the cover is too thin to exhibit sufficient rebound characteristics of the thread rubber layer, and the cover is easy to break when repeatedly hitting. On the other hand, when the thickness is larger than 3.0 mm, the shot feel is poor.

At the time of molding the cover, many depressions called "dimples" may be optionally formed on the surface of the golf ball. Furthermore, paint finishing or marking with a stamp may be optionally provided after the cover is molded for commercial purposes.

EXAMPLES

The following Examples and Comparative Examples further illustrate the present invention in detail but are not to be construed to limit the scope of the present invention.

Production of Solid Center

Each spherical solid center was obtained by mixing the rubber composition for the solid center having the formulation shown in Tables 1 and 2, and press-molding the mixture at the condition shown in the same tables. A diameter, a weight, a surface hardness, a center hardness, a ratio of the surface hardness to the diameter, and a ratio of the center hardness to the diameter of the resulting solid center were measured, and the results are shown in the same Tables. The weight of the solid center was adjusted by an amount of a barium sulfate so that the resulting golf ball has a desired weight.

Table 1

| | | (parts by weight) | | | |
|---|---|---|---|---|---|
| Center composition | | A | B | C | D |
| BR11 *1 | | 100 | 100 | 100 | 100 |
| Zinc acrylate | | 28 | 28 | 28 | 28 |
| Dicumyl peroxide | | 1.5 | 1.5 | 1.5 | 1.5 |
| Zinc oxide | | 15 | 15 | 15 | 15 |
| Barium sulfate | | proper amount | proper amount | proper amount | proper amount |
| Antioxidant *2 | | 0.5 | 0.5 | 0.5 | 0.5 |
| Vulcanization condition | | | | | |
| The first stage | Temp.(° C.) | 165 | 145 | 165 | 165 |
| | Time(min) | 20 | 24 | 20 | 20 |
| The second stage | Temp.(° C.) | — | 165 | — | — |
| | Time(min) | — | 8 | — | — |
| Diameter of the center ① (mm) | | 30.0 | 36.0 | 36.0 | 38.5 |
| Weight of the center (g) | | 20.5 | 30.0 | 30.0 | 34.5 |
| Surface hardness of the center (JIS-C) ② | | 80 | 76 | 80 | 80 |
| Center hardness of the center (JIS-C) ③ | | 68 | 75 | 65 | 64 |
| Hardness difference (②-③) | | 12 | 1 | 15 | 16 |

Table 1-continued

| Center composition | (parts by weight) A | B | C | D |
|---|---|---|---|---|
| Ratio of ②/① | 2.67 | 2.11 | 2.22 | 2.08 |
| Ratio of ③/① | 2.20 | 2.08 | 1.81 | 1.66 |

TABLE 2

| Center composition | (parts by weight) E | F | G | H | I |
|---|---|---|---|---|---|
| BR11 *1 | 100 | 100 | 100 | 100 | 100 |
| Zinc acrylate | 28 | 28 | 30 | 32 | 25 |
| Dicumyl peroxide | 1.5 | 1.5 | 1.5 | 1.5 | 1.5 |
| Zinc oxide | 15 | 15 | 15 | 15 | 15 |
| Barium sulfate | proper amount | proper amount | proper amount | proper amount | proper amount |
| Antioxidant *2 | 0.5 | 0.5 | 0.5 | 0.5 | 0.5 |
| Vulcanization condition | | | | | |
| Temperature (° C.) | 155 | 160 | 165 | 170 | 165 |
| Time (minutes) | 30 | 25 | 20 | 18 | 25 |
| Diameter of the center ① (mm) | 36.0 | 36.0 | 34.0 | 34.0 | 36.0 |
| Weight of the center (g) | 30.0 | 30.0 | 27.0 | 27.0 | 30.0 |
| Surface hardness of the center (JIS-C) ② | 78 | 79 | 82 | 85 | 76 |
| Center hardness of the center (JIS-C) ③ | 68 | 67 | 67 | 68 | 63 |
| Hardness difference (②–③) | 10 | 12 | 15 | 17 | 13 |
| Ratio of ②/① | 2.17 | 2.19 | 2.41 | 2.50 | 2.11 |
| Ratio of ③/① | 1.89 | 1.86 | 1.97 | 2.00 | 1.75 |

*1: High-cis polybutadiene (trade name "BR 11") from JSR Co., Ltd., Content of 1,4-cis-polybutadiene: 96%
*2: Antioxidant (trade name "Noclac NS-6") 2,5-di-t-butylhydroquinone from Ouchi Shinko Chemical Industries Co., Ltd.

Formation of Thread Rubber Layer

Each thread rubber layer was then formed on the solid center by winding the thread rubber. The thread rubber was prepared from a blend of natural rubber and a low cis-isoprene rubber ("Shell IR-309" commercially available from Shell Chemical Co., Ltd.)=50/50 (weight ratio). A diameter after winding the thread rubber was about 39.0 mm.

Preparation of Cover Composition

The formulation materials shown in Table 3 were mixed using a kneading type twin-screw extruder to obtain pelletized cover compositions. The extrusion condition were a screw diameter of 45 mm, a screw speed of 200 rpm, and a screw L/D of 35.

The formulation materials were heated at 200 to 260° C. at the die position of the extruder. The Shore D hardness and flexural modulus of the resulting cover compositions were also shown in the same Table. The flexural modulus was determined according to ASTMD-747, using a sample of a heat and press molded sheet having a thickness of about 2 mm from each composition, which had been stored at 23° C. for 2 weeks. The Shore D hardness was determined according to ASTM D-2240, using a sample of a stack of the three or more sheets described above.

TABLE 3

| Cover composition | (parts by weight) a | b | c | d | e | f | g |
|---|---|---|---|---|---|---|---|
| Hi-milan 1605 *3 | — | — | — | 20 | — | 20 | — |
| Hi-milan 1557 *4 | — | — | — | 5 | — | | — |
| Hi-milan 1855 *5 | 15 | — | 20 | 75 | — | 30 | — |
| Hi-milan 1706 *6 | — | — | — | — | — | 20 | — |
| Hi-milan AM7316 *7 | 85 | — | — | — | — | — | — |
| Hi-milan AM7317 *8 | — | — | — | — | — | — | 50 |
| Hi-milan AM7318 *9 | — | — | — | — | — | — | 50 |
| Surlyn AD8511 *10 | — | 30 | 25 | — | 25 | — | — |
| Surlyn AD8512 *11 | — | 30 | 25 | — | 25 | — | — |
| Neucrel AN4212C *12 | — | — | — | — | — | 30 | — |
| Taftek Z514 *13 | — | 25 | 20 | — | — | — | — |
| Bondine AX8390 *14 | — | | 10 | — | — | — | — |
| AR-201 *15 | — | 15 | — | — | — | — | — |
| Epofriend A1010 *16 | — | — | — | — | 15 | — | — |
| Cepton HG-252 *17 | — | — | — | — | 35 | — | — |
| Titanium dioxide | 2 | 2 | 2 | 2 | 2 | 2 | 2 |
| Barium sulfate | 2 | 2 | 2 | 2 | 2 | 2 | 2 |
| Cover Shore D hardness | 37 | 47 | 50 | 56 | 52 | 54 | 66 |
| Flexural modulus (MPa) | 34 | 130 | 135 | 150 | 90 | 150 | 420 |

*3 Hi-milan 1605 (trade name), ethylene-methacrylic acid copolymer ionomer resin obtained by neutralizing with sodium ion, manufactured by Mitsui Du Pont Polychemical Co., Ltd., MI = 2.8, flexural modulus = about 310 MPa
*4 Hi-milan 1557 (trade name), ethylene-methacrylic acid copolymer ionomer resin obtained by neutralizing with zinc ion, manufactured by Mitsui Du Pont Polychemical Co., Ltd., MI = 5.0, flexural modulus = about 230 MPa
*5 Hi-milan 1855 (trade name), ethylene-butyl acrylate-methacrylic acid terpolymer ionomer resin obtained by neutralizing with zinc ion, manufactured by Mitsui Du Pont Polychemical Co., Ltd., MI = 1.0, flexural modulus = about 90 MPa
*6 Hi-milan 1706 (trade name), ethylene-methacrylic acid copolymer ionomer resin obtained by neutralizing with zinc ion, manufactured by Mitsui Du Pont Polychemical Co., Ltd., MI = 0.8, flexural modulus = about 260 MPa
*7 Hi-milan AM7316 (trade name), ethylene-butyl acrylate-methacrylic acid terpolymer ionomer resin obtained by neutralizing with zinc ion, manufactured by Mitsui Du Pont Polychemical Co., Ltd., MI = 1.5, flexural modulus = about 24 MPa
*8 Hi-milan AM7317 (trade name), ethylene-methacrylic acid copolymer ionomer resin obtained by neutralizing with zinc ion, manufactured by Mitsui Du Pont Polychemical Co., Ltd., MI = 1.1, flexural modulus = about 310 MPa
*9 Hi-milan AM7318 (trade name), ethylene-methacrylic acid copolymer ionomer resin obtained by neutralizing with sodium ion, manufactured by Mitsui Du Pont Polychemical Co., Ltd., MI = 2.1, flexural modulus = about 350 MPa
*10 Surlyn AD8511 (trade name), ethylene-methacrylic acid copolymer ionomer resin obtained by neutralizing with zinc ion, manufactured by Du Pont Co., MI = 3.4, flexural modulus = about 220 MPa
*11 Surlyn AD8512 (trade name), ethylene-methacrylic acid copolymer ionomer resin obtained by neutralizing with sodium ion, manufactured by Du Pont Co., MI = 4.4, flexural modulus = about 280 MPa
*12 Neucrel AN4212C (trade name), ethylene-isobutyl acrylate-methacrylic acid terpolymer resin [polymerization composition ratio: 76/20/4 (weight ratio)], manufactured by Mitsui Du Pont Polychemical Co., Ltd., MI = 12
*13 Taftek Z514 (trade name), glycidyl methacrylate adduct of hydrogenated styrene-butadiene-styrene-block copolymer, manufactured by Asahi Chemical Industries Co., Ltd., JIS-A hardness = 84, content of styrene = about 30% by weight, content of hydrogenated butadiene = about 70% by weight, content of glycidyl methacrylate = about 1% by weight
*14 Bondine AX8390 (trade name), ethylene-ethyl acrylate-maleic anhydride terpolymer resin, manufactured by Sumitomo Chemical Industries Co., Ltd., MI = 7.0, Shore D hardness = 14, content of ethyl acrylate + maleic anhydride = 32% (content of maleic anhydride: 1 to 4%)
*15 AR-201 (trade name), product obtained by graft-modifying ethylene-ethyl acrylate copolymers with maleic anhydride, manufactured by Mitsui Du Pont Polychemical Co., Ltd., JIS-A hardness = 51
*16 Epofriend A1010 (trade name), styrene-butadiene-styrene structure block copolymer having a polybutadiene block with epoxy groups, manufactured by Daicel Chemical Industries, Ltd., styrene/butadiene (weight ratio) = 40/60, JIS-A hardness = 67, content of epoxy: about 1.5 to 1.7% by weight
*17 Cepton HG-252 (trade name), hydrogenated styrene-isoprene-styrene block copolymer having a terminal OH group, manufactured by Kuraray Co. Ltd., JIS-A hardness = 80, content of styrene = about 40% by weight Examples 1 to 9 and Comparative Examples 1 to 6

The resulting cover com positions were preliminary molded into semi-spherical half-shells, encapsuling the resulting thread wound core with the two half-shells, followed by press-molding in the mold for golf ball and then coating with a paint to obtain a thread wound golf ball having an outer diameter of 42.8 mm. Flight performance (initial velocity, spin amount, carry and run) and shot feel were measured or evaluated, and the results are shown in Tables 4 and 5 (Examples) and Table 6 (Comparative Examples). The test methods are as follows.

Test method (1) Flight Performance 1

After a No. 1 wood club (a driver, W#1) was mounted to a swing robot manufactured by True Temper Co. and a golf ball was hit at head speed of 45 m/sec, the initial velocity, spin amount and flight distance were measured. The spin amount was measured by continuously taking a photograph of a mark provided on the hit golf ball using a high-speed camera. As the flight distance, carry was measured. Carry is a flight distance to the firstly dropping point on the ground.

(2) Flight Performance 2

After a sand wedge (#SW) was mounted to a swing robot manufactured by True Temper Co. and a golf ball was hit at head speed of 20 m/sec, spin amount and flight distance. As the flight distance, carry and run was measured. Run is a flight distance subtracted carry from total.

(3) Shot Feel

The shot feel of the golf ball is evaluated by 10 top professional golfers according to a practical hitting test using a No. 1 wood club. The evaluation criteria are as follows. The results shown in the Tables below are based on the fact that not less than 8 out of 10 professional golfers evaluated with the same criteria.

Evaluation Criteria:

β: Not less than 8 out of 10 golfers felt that the golf ball has soft and good shot feel.

Δ: From 3 to 7 out of 10 golfers felt that the golf ball has soft and good shot feel.

X: Not less than 8 out of 10 golfers felt that the golf ball has hard and poor shot feel.

Test Results

TABLE 4

| Example No. | 1 | 2 | 3 | 4 | 5 |
|---|---|---|---|---|---|
| Center composition | C | C | C | C | C |
| Cover composition | b | c | d | e | f |
| Flight performance 1 (W#1) | | | | | |
| Initial velocity (m/sec) | 64.1 | 64.2 | 64.3 | 64.3 | 64.2 |
| Spin amount (rpm) | 2650 | 2690 | 2630 | 2680 | 2740 |
| Carry (yard) | 226.5 | 226.9 | 227.2 | 227.1 | 226.8 |
| Flight performance 2 (#SW) | | | | | |
| Spin amount (rpm) | 7850 | 7810 | 7750 | 7800 | 7760 |
| Carry (yard) | 28.5 | 28.3 | 28.6 | 28.6 | 28.5 |
| Run (yard) | 0.4 | 0.5 | 0.6 | 0.5 | 0.6 |
| Shot feel | ○ | ○ | ○ | ○ | ○ |

TABLE 5

| Example No. | 6 | 7 | 8 | 9 |
|---|---|---|---|---|
| Center composition | E | F | G | H |
| Cover composition | e | e | e | e |
| Flight performance 1 (W#1) | | | | |
| Initial velocity (m/sec) | 64.5 | 64.4 | 64.4 | 64.5 |
| Spin amount (rpm) | 2850 | 2730 | 2680 | 2780 |
| Carry (yard) | 225.0 | 226.5 | 227.0 | 225.5 |
| Flight performance 2 (#SW) | | | | |
| Spin amount (rpm) | 7880 | 7830 | 7850 | 7900 |
| Carry (yard) | 28.5 | 28.6 | 28.6 | 28.5 |
| Run (yard) | 0.4 | 0.5 | 0.5 | 0.3 |
| Shot feel | Δ | ○ | ○ | ○ |

TABLE 6

| Comparative Example No. | 1 | 2 | 3 | 4 | 5 | 6 |
|---|---|---|---|---|---|---|
| Center composition | A | B | D | C | C | I |
| Cover composition | e | e | e | a | g | e |
| Flight performance 1 (W#1) | | | | | | |
| Initial velocity (m/sec) | 64.4 | 64.4 | 62.8 | 63.5 | 64.6 | 63.5 |
| Spin amount (rpm) | 3150 | 3020 | 2630 | 3110 | 2600 | 2600 |
| Carry (yard) | 220.3 | 222.5 | 221.5 | 221.0 | 227.0 | 223.0 |
| Flight performance 2 (#SW) | | | | | | |
| Spin amount (rpm) | 8010 | 7980 | 7920 | 8230 | 6300 | 7680 |
| Carry (yard) | 28.0 | 28.1 | 28.4 | 27.5 | 29.8 | 28.1 |
| Run (yard) | 0.4 | 0.4 | 0.8 | 0.8 | 1.5 | 0.7 |
| Shot feel | ○ | x | ○ | ○ | x | ○ |

As is apparent from Table 4 to Table 6, the golf balls of Examples 1 to 9 had longer flight distance than the conventional thread wound golf balls of the Comparative Examples, and soft and good shot feel which were evaluated by top professional golfers.

Since the golf balls of Example 4 and Comparative Examples 1 to 3 have the same cover composition, the golf balls have the same level of spin amount when hit by a sand wedge. However, the golf balls of Comparative Examples 1 and 2 have short flight distance, because the spin amount when hit by a driver is too large.

The golf ball of Comparative Example 3 has short flight distance, because the initial velocity is too low. The golf ball of Comparative Example 2 has poor shot feel, because the ratio of center hardness to the diameter of the solid center is large and the solid center is too hard.

The golf ball of Comparative Example 4 has short flight distance, because the cover hardness is low, the spin amount when hit by a driver,is high and the initial velocity is low. The golf ball of Comparative Example 5 has long flight distance, but has hard and poor shot feel, because the cover hardness is too high. The golf ball of Comparative Example 6 has low initial velocity and short flight distance, because the ratio of surface hardness to the diameter of the solid center is small.

What is claimed is:

1. A thread wound golf ball comprising a solid center, a thread rubber layer formed on the solid center, and a cover covering the thread rubber layer, wherein the solid center has a diameter of 33 to 38 mm, a ratio of surface hardness in JIS-C hardness to diameter of 2.15 to 2.50, and a ratio of center hardness in JIS-C-hardness to diameter of 1.30 to 2.00, the cover has a Shore D hardness of 40 to 65, the solid center has a center hardness in JIS-C hardness of 50 to 75, and has a surface hardness larger than the center hardness by not less than 10, and the thread rubber layer has a thickness of 1.0 to 4.0 mm.

2. The thread wound golf ball according to claim 1, wherein the cover has a thickness of 1.0 to 3.0 mm.

3. The thread wound golf ball, according to claim 1, wherein the thread rubber layer is formed on the solid center, and the solid center is formed from a rubber composition comprising a base rubber, a co-crosslinking agent, an organic peroxide, and a filler, said base: rubber comprising natural and or synthetic rubber and said co-crosslinking agent comprising a metal salt of an α,β-unsaturated carboxylic acid.

4. The thread wound golf ball, according to claim 3, further comprising high-cis polybutadine rubber containing cis-1, 4 bond of not less than 40%.

5. The thread wound golf ball, according to claim 3, further comprising zinc or magnesium salts of α, β-unsaturated carboxylic acids having 3 to 8 carbon atoms as co-crosslinking agents.

6. The thread wound golf ball, according to claim 3, further comprising an organic peroxide selected from the group consisting of dicumyl peroxide, 1,1-bis (t-butylperoxy)-3,3,5-trimethylcyclohexane, 2,5-dimethyl-2,5-di(t-butylperoxy)-hexone; and di-t-butyl peroxide.

7. The thread wound golf ball, according to claim 3, further comprising a filler selected from the group consisting of zinc oxide; barium sulfate; calcium carbonate; tungsten powder; and molybdenum powder.

8. The thread wound golf ball, according to claim 3, wherein said rubber composition comprises a mixture of high-cis polybutadiene rubber and natural rubber or polyisoprene rubber or styrene-butadiene rubber, or ethylene-propylene-diene rubber.

9. The thread wound golf ball, according to claim 3, wherein the amount of co-crosslinking agent ranges from 10 to 40 parts by weight based on 100 parts by weight of the base rubber.

10. The thread wound golf ball, according to claim 3, wherein the amount of organic peroxide ranges from 0.5 to 2.0 parts by weight based on 100 parts by weight of the base rubber.

11. The thread wound golf ball, according to claim 3, wherein the thread rubber is wound on the solid center, and comprises a rubber obtained by vulcanizing a rubber composition prepared by formulating sulfur, a vulcanization accelerator, a vulcanization aid, an antioxidant to a natural rubber or a blend of the natural rubber and a synthetic polyisoprene.

12. The thread wound golf ball, according to claim 3, wherein the cover covering the thread rubber layer comprises an ionomer resin.

13. The thread wound golf ball, according to claim 1, wherein the cover covering the thread rubber layer comprises an ionomer resin combined with a thermoplastic elastomer or resin.

14. The thread wound golf ball, according to claim 3, wherein said thermoplastic elastomer comprises an epoxy group modified elastomer.

15. The thread wound golf ball, according to claim 13, wherein said thermoplastic elastomer. is combined with a glycidyl group-modified thermoplastic elastomer.

16. The thread wound golf ball, according to claim 13, wherein said thermoplastic elastomer comprises a terpolymer of ethylene-unsaturated carboxylic acid ester-unsaturated carboxylic acid.

17. The thread wound golf ball, according to claim 13, wherein said thermoplastic elastomer comprises a mixture of a maleic anhydride-modified thermoplastic elastomer or a terminal OH-containing thermoplastic elastomer, and an epoxy group-modified thermoplastic elastomer.

18. The thread wound golf ball, according to claim 13, wherein the ratio of ionomer resin to the other resin including the epoxy group modified thermoplastic elastomer, the maleic anhydride-modified thermoplastic elastomer and the terpolymer of ethylene-unsaturated carboxylic acid ester-unsaturated carboxylic acid is 95:5 to 20:80.

* * * * *